US012405043B2

(12) United States Patent
Reardon et al.

(10) Patent No.: US 12,405,043 B2
(45) Date of Patent: Sep. 2, 2025

(54) HVAC SYSTEM WITH OUTDOOR FAN SPEED CONTROL BYPASS

(71) Applicant: Johnson Controls Tyco IP Holdings LLP, Milwaukee, WI (US)

(72) Inventors: Anthony J. Reardon, Norman, OK (US); Gregory Ulizio, Oklahoma City, OK (US)

(73) Assignee: Johnson Controls Light Commercial IP GmbH, Neuhausen am Rheinfall (CH)

( * ) Notice: Subject to any disclaimer, the term of this patent is extended or adjusted under 35 U.S.C. 154(b) by 31 days.

(21) Appl. No.: 18/227,230

(22) Filed: Jul. 27, 2023

(65) Prior Publication Data

US 2024/0035724 A1 Feb. 1, 2024

Related U.S. Application Data

(60) Provisional application No. 63/392,781, filed on Jul. 27, 2022.

(51) Int. Cl.
*F25B 49/02* (2006.01)

(52) U.S. Cl.
CPC ..... *F25B 49/025* (2013.01); *F25B 2500/31* (2013.01); *F25B 2600/11* (2013.01); *F25B 2600/111* (2013.01); *F25B 2700/1931* (2013.01); *F25B 2700/2106* (2013.01)

(58) Field of Classification Search
CPC ..... F25B 49/025; F25B 49/027; F25B 2313/0294; F25B 2500/31; F25B 2600/11; F25B 2600/111; F25B 2700/1931; F25B 2700/2106
See application file for complete search history.

(56) References Cited

U.S. PATENT DOCUMENTS 3,739,596 A * 6/1973 Ballard ..... F25B 49/027 62/226
5,823,004 A * 10/1998 Polley ..... F24F 11/77 62/181
2009/0043426 A1* 2/2009 Oh ..... F24F 11/88 62/515
2011/0018473 A1* 1/2011 Rockenfeller ..... H02P 1/30 318/112
2014/0214213 A1* 7/2014 Rockenfeller ..... F24F 11/63 700/276
2021/0348800 A1* 11/2021 Suvvada ..... F24F 1/38

FOREIGN PATENT DOCUMENTS

CA 3134876 A1 * 10/2020 ..... F24F 1/0003

* cited by examiner

*Primary Examiner* — Jonathan Bradford
(74) *Attorney, Agent, or Firm* — Fletcher Yoder, P.C.

(57) ABSTRACT

A heating, ventilation, and air conditioning (HVAC) system includes an outdoor heat exchanger configured to circulate a working fluid therethrough and to place the working fluid in a heat exchange relationship with an ambient air flow, a fan configured to direct the ambient air flow across the outdoor heat exchanger, a motor configured to drive rotation of the fan, and a control system electrically coupled to the motor. The control system includes a fan controller configured to modulate a speed of the fan, and the control system is configured to selectively enable and disable electrical communication from the fan controller to the motor in response to an ambient temperature detected by the control system.

19 Claims, 9 Drawing Sheets

HVAC SYSTEM WITH OUTDOOR FAN SPEED CONTROL BYPASS

CROSS REFERENCE TO RELATED APPLICATIONS

This application claims priority to and the benefit of U.S. Provisional Application No. 63/392,781, entitled "TEMPERATURE ACTIVATED BYPASS FOR OUTDOOR FAN MOTOR SPEED CONTROL," filed Jul. 27, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. Unfortunately, in some operating conditions, the HVAC system may be susceptible to inefficiencies. For example, during low ambient environment conditions, the HVAC system may be susceptible to low pressures of refrigerant within the vapor compression circuit, which may cause operational efficiencies. In some HVAC systems, operation a fan configured to direct air across a heat exchanger of the vapor compression circuit may be adjusted based on detected pressures within the vapor compression circuit. For example, a speed of the fan may be reduced. Unfortunately, certain fan motors may be susceptible to overheating in some operating conditions.

SUMMARY

In one embodiment, a heating, ventilation, and air conditioning (HVAC) system includes an outdoor heat exchanger configured to circulate a working fluid therethrough and to place the working fluid in a heat exchange relationship with an ambient air flow, a fan configured to direct the ambient air flow across the outdoor heat exchanger, a motor configured to drive rotation of the fan, and a control system electrically coupled to the motor. The control system includes a fan controller configured to modulate a speed of the fan, and the control system is configured to selectively enable and disable electrical communication from the fan controller to the motor in response to an ambient temperature detected by the control system.

In another embodiment, a fan control system for a heating, ventilation, and air conditioning (HVAC) system includes a fan controller configured to modulate a speed of a fan configured to direct an ambient air flow across an outdoor heat exchanger, where the fan controller is configured to receive power from a power source and to output a variable voltage to a motor of the fan. The fan control system also includes a first contactor configured to be disposed between the power source and the motor in parallel with the fan controller, where the first contactor is configured to electrically couple the power source and the motor, such that the first contactor is configured to direct power from the power source to the motor and bypass the fan controller. The fan control system further includes a second contactor configured to be disposed between the fan controller and the motor in series, where the second contactor is configured to electrically couple the fan controller and the motor. The fan control system is configured to selectively close the first contactor and open the second contactor and to selectively open the first contactor and close the second contactor based on an ambient temperature detected by the fan control system.

In a further embodiment, a heating, ventilation, and air conditioning (HVAC) system includes a motor configured to drive rotation of a fan to direct an ambient air flow across an outdoor heat exchanger and a control system electrically coupled to the motor and configured to control operation of the motor. The control system includes a fan controller configured to receive power from a power source and to output a variable voltage to the motor to modulate a speed of the fan, a first contactor configured to be disposed between the power source and the motor in parallel with the fan controller, a second contactor configured to be disposed between the fan controller and the motor and in series with the fan controller and the motor, a temperature switch configured detect an ambient temperature, where the temperature switch is configured to selectively output a first signal based on a value of the ambient temperature, and a relay electrically coupled to the temperature switch, the first contractor and, the second contactor. The relay is configured to output a second signal to selectively actuate the first contactor and the second contactor based on receipt of the first signal from the temperature switch.

DETAILED DESCRIPTION

Figure 1:
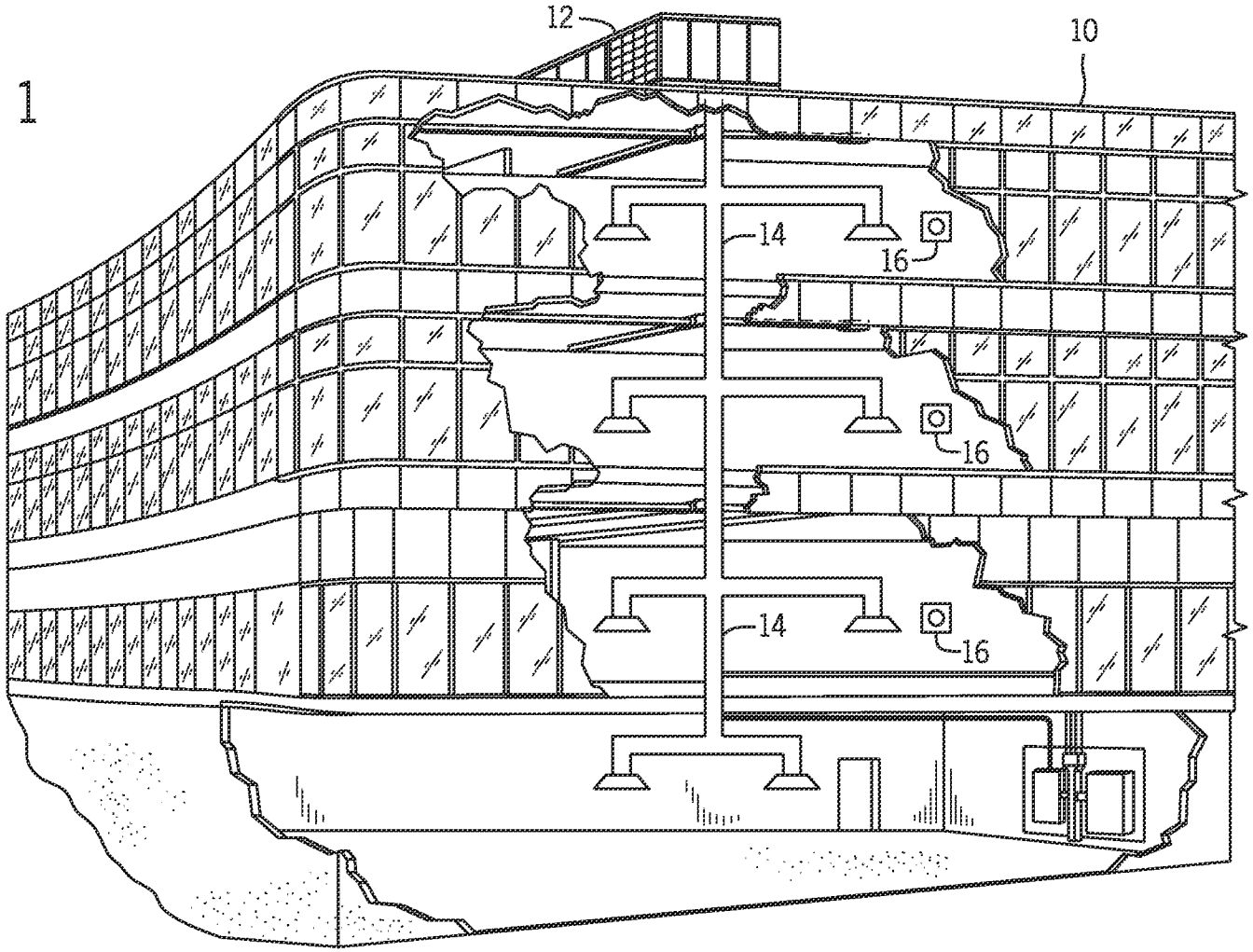
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit (e.g., refrigerant circuit). A compressor may be used to circulate the working fluid through the conduits and other components of the working fluid circuit (e.g., an expansion device) and, thus, enable the transfer of thermal energy between components of the working fluid circuit (e.g., between the condenser and the evaporator) and one or more thermal loads (e.g., an environmental air flow, a supply air flow).

In some embodiments, the HVAC system may include a heat pump (e.g., a heat pump system, a reverse-cycle heat pump) having a first heat exchanger (e.g., a heating and/or cooling coil, an indoor coil, the evaporator) positioned within a building and/or the space to be conditioned, a second heat exchanger (e.g., a heating and/or cooling coil, an outdoor coil, the condenser) positioned in or otherwise fluidly coupled to an ambient environment (e.g., the atmosphere), and a pump (e.g., the compressor) configured to circulate the working fluid (e.g., refrigerant) between the first and second heat exchangers to enable heat transfer between the thermal load (e.g., an air flow to be conditioned) and the ambient environment, for example. The heat pump system is operable to provide both cooling and heating to the space to be conditioned (e.g., a room, zone, or other region within a building) by adjusting a flow of the working fluid through the working fluid circuit.

During operation of the HVAC system in a cooling mode, the compressor may direct working fluid through the working fluid circuit and the first and second heat exchangers in a first flow direction. While receiving working fluid in the first flow direction, the first heat exchanger (which may operate to condition an air flow supplied to a space to be conditioned) may operate as an evaporator and, thus, enable working fluid flowing through the first heat exchanger to absorb thermal energy from an air flow directed to the space. Further, the second heat exchanger (which may be positioned in the ambient environment surrounding the heat pump system), may operate as a condenser to reject the heat absorbed by the working fluid flowing from the first heat exchanger (e.g., to an ambient air flow directed across the second heat exchanger). In this way, the heat pump system may facilitate cooling of the space or other thermal load serviced by (e.g., in thermal communication with) the first heat exchanger.

Unfortunately, in certain operating conditions, the HVAC system may operate inefficiently and/or may be susceptible to operational interruptions. For example, during cold ambient (e.g., atmospheric) conditions, a pressure of the working fluid circulated within the working fluid circuit may fall below an acceptable or desirable level. In traditional HVAC systems, low pressure levels of working fluid within the working fluid circuit may cause inefficient operation and/or operational interruption (e.g., "tripping") of the HVAC system. In some instances, operation of the HVAC system may be suspended, and intervention by a technician or operator of the HVAC system may be prompted. During operation of the HVAC system in a cooling mode, the first heat exchanger (e.g., evaporator, indoor coil) of the HVAC system may be susceptible to freezing in cold ambient conditions, which may result in operational inefficiencies and/or operational interruptions. Further, during cold ambient conditions, reduced pressure (e.g., head pressure, compressor discharge pressure) of the working fluid within the working fluid circuit may hinder proper operation of other components of the HVAC system, such as the compressor and/or the expansion device of the working fluid circuit. Indeed, low pressures of the working fluid within the working fluid circuit may result in various operational inefficiencies and/or operational interruptions of the HVAC system.

As will be appreciated, during cold ambient conditions, ambient air flow directed across an outdoor heat exchanger (e.g., outdoor coil, condenser) of the HVAC system may absorb an increased amount of thermal energy or heat circulated through the outdoor heat exchanger. As an increased amount of heat is transferred from the working fluid to the ambient air, the temperature and the pressure of the working fluid decreases. Thus, to avoid decreases of the working fluid pressure within the working fluid circuit below a desirable level, HVAC systems may be configured to adjust a speed of a fan configured to direct the ambient air flow across the outdoor heat exchanger. More specifically, during cold ambient conditions, the HVAC system may be configured to reduce a speed of an outdoor fan configured to direct the ambient air across the outdoor heat exchanger. For example, the HVAC system may adjust the speed of the outdoor fan based on a detected pressure of the working fluid discharged from the compressor. In particular, the HVAC system may reduce a speed of the outdoor fan, and thereby reduce an amount of ambient air flow directed across the outdoor heat exchanger, in response to the detected discharge pressure falling below a first threshold level (e.g., lower pressure limit). Similarly, in response to the detected discharge pressure rising above below a second threshold level (e.g., upper pressure limit), the HVAC system may increase the speed of the outdoor fan and thereby increase an amount of ambient air flow directed across the outdoor heat exchanger. In this way, the HVAC system may adjust operation of the outdoor fan to maintain the discharge pressure of the working fluid within a desired working fluid pressure range.

Unfortunately, existing motors utilized to drive operation of fans may be vulnerable to operational inefficiencies and interruptions that may be induced during operation to adjust speeds of the fan. For example, a single-phase fan motor may be utilized to drive rotation of the outdoor fan, and the single-phase fan motor may be susceptible to overheating at reduced rotational speeds (e.g., speeds less than full speed). In particular, motor windings of the single-phase fan motor may increase in temperature and cause overheating of the fan motor during operation of the fan motor at lower speeds in certain operating conditions (e.g., ambient temperatures). As will be appreciated, overheating of the fan motor may result in increased maintenance on the fan motor and/or HVAC system, reduced useful life of the fan motor, increased downtime (e.g., operational interruption) of the HVAC system, reduced cooling capacity of the HVAC system, increased costs, and so forth. It is presently recognized that improved control systems configured to operate fans of HVAC systems to maintain desired working fluid pressures with improved reliability are desired.

Accordingly, embodiments of the present disclosure are directed to an HVAC system configured to regulate operation of a fan, such as an outdoor fan and/or a condenser fan, based on a detected ambient temperature. As discussed in further detail below, the HVAC system includes a control system configured to selectively enable modulation of a speed of the fan and selectively bypass (e.g., block) modulation of the speed of the fan based on the detected ambient temperature. In particular, the control system is configured to enable modulation of the fan speed at lower ambient temperatures and is configured to block modulation of the fan speed at higher ambient temperatures. To this end, the control system may include a fan controller (e.g., speed controller), one or more temperature switches, one or more relays, and one or more contactors, for example. By enabling variable speed control of the fan during colder ambient conditions, the HVAC system may be operated to maintain the pressure of the working fluid within a desired pressure range, and by blocking variable speed control of the fan in warmer ambient conditions, overheating of the fan motor (e.g., single-phase motor) may be avoided. In this way, the disclosed techniques enable more reliable operation of the HVAC system.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building from the HVAC unit 12. For example, the ductwork 14 may extend to various individual floors or other sections of the building 10. In certain embodiments, the HVAC unit 12 may be a heat pump that provides both heating and cooling to the building with one working fluid circuit configured to operate in different modes. In other embodiments, the HVAC unit 12 may include one or more working fluid circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
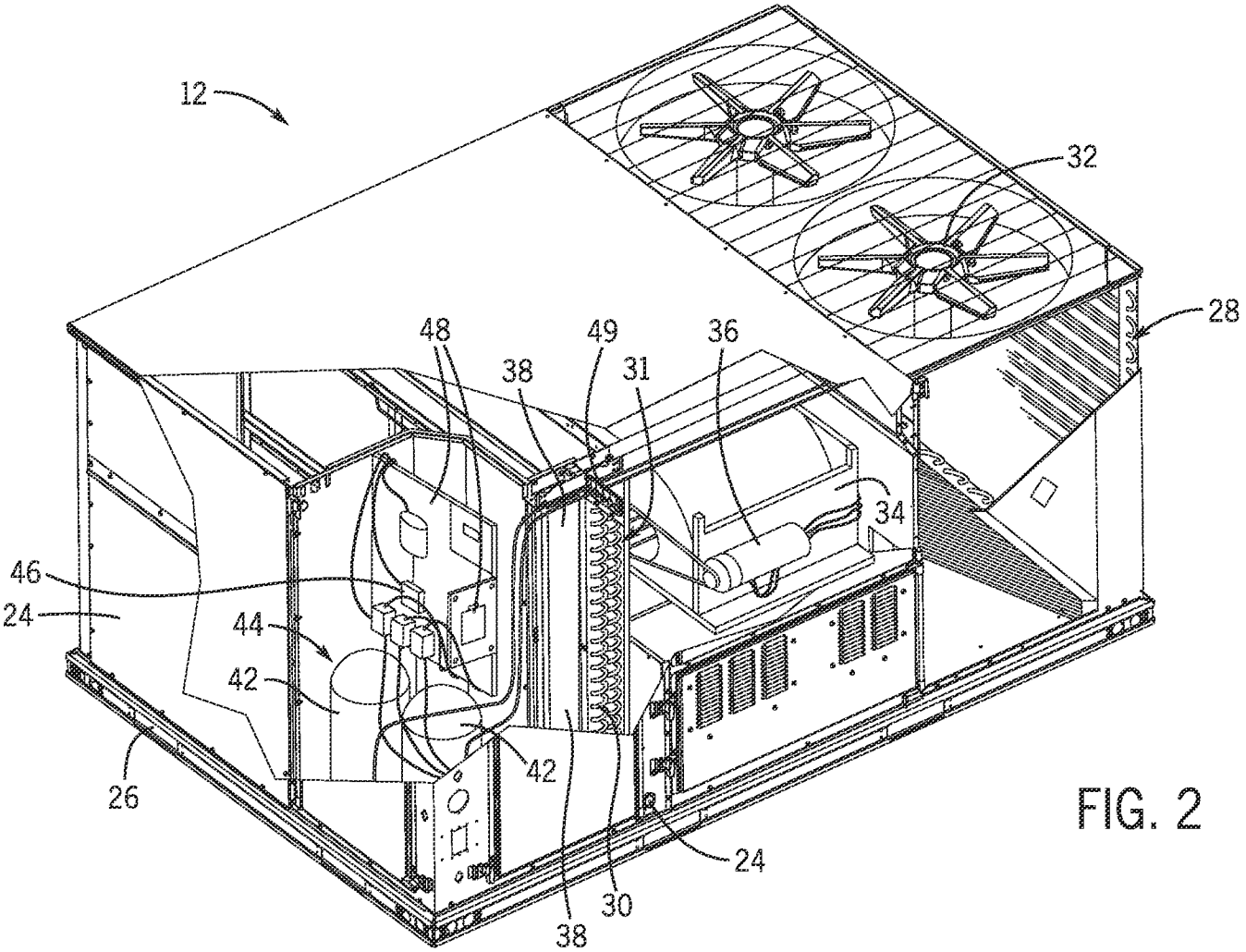
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent working fluid circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more working fluid circuits. Tubes within the heat exchangers 28 and 30 may circulate working fluid (e.g., refrigerant), such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
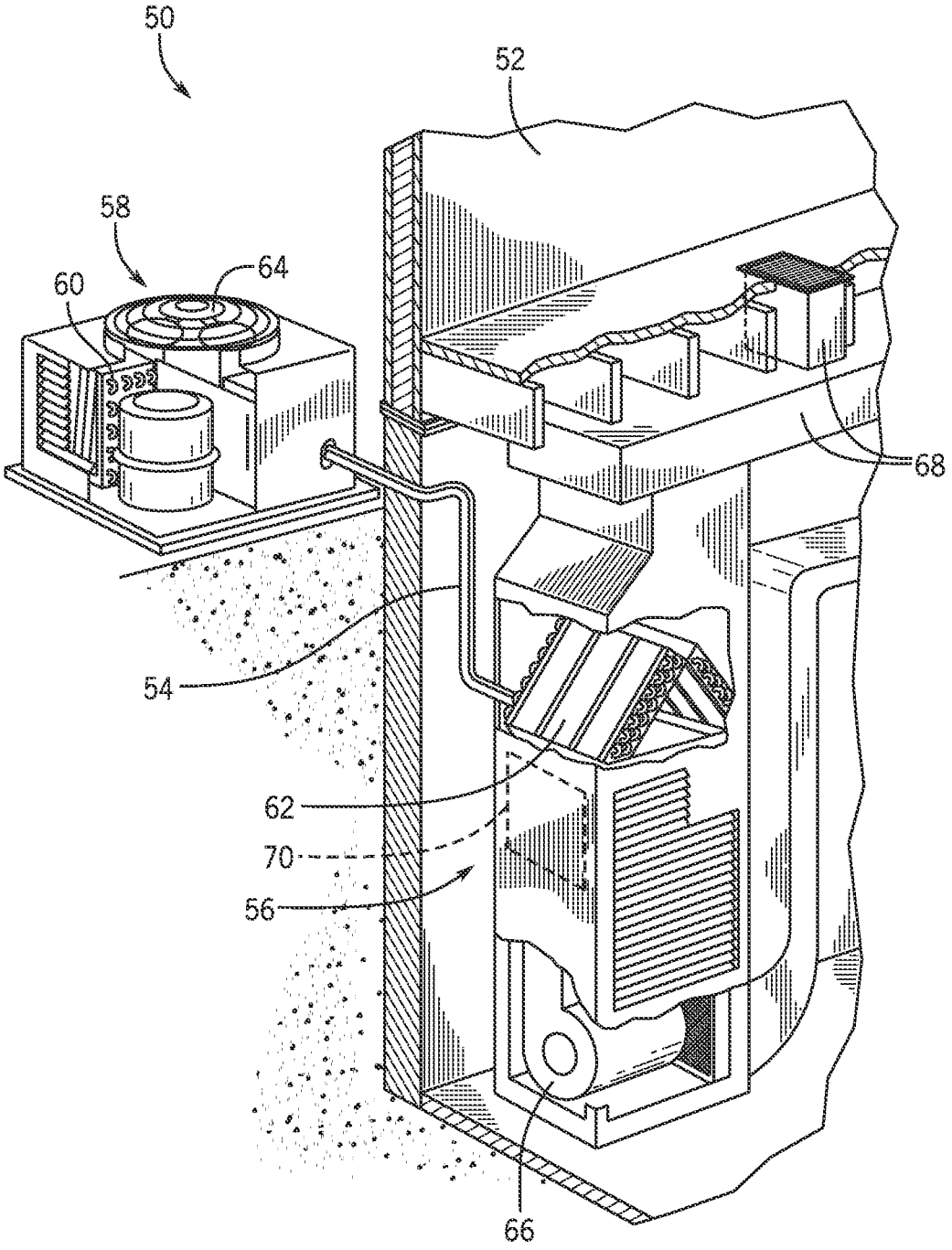
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
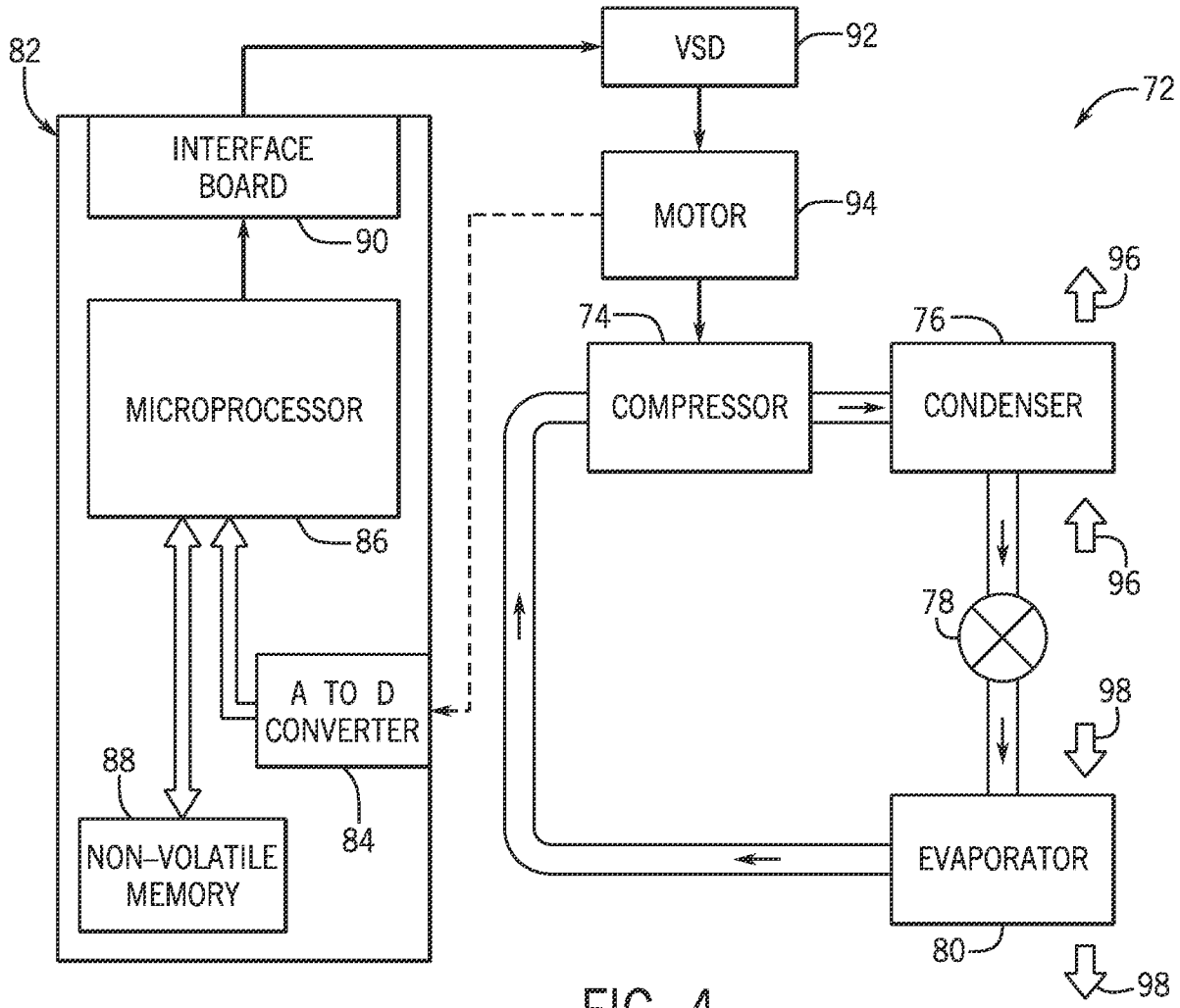
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a working fluid through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, embodiments of the present disclosure are directed to an HVAC system configured to enable improved operation of the HVAC system in cold (e.g., low) ambient conditions. In particular, present embodiments include a control system configured to enable improved (e.g., more efficient, more reliable) operation of a fan of the HVAC system during cold ambient conditions. The control system is configured to regulate operation of the fan, such as an outdoor fan and/or a condenser fan, based on a detected ambient temperature. Specifically, the control system is configured to selectively enable modulation of a speed of the fan and selectively bypass (e.g., block) modulation of the speed of the fan based on the detected ambient temperature. For example, the control system may be configured to enable modulation of the fan speed at lower ambient temperatures and may be configured to block modulation of the fan speed at higher ambient temperatures. To this end, the control system may include a fan controller (e.g., speed controller), one or more temperature switches, one or more relays, and one or more contactors, as described in further detail below. By enabling variable speed control of the fan during colder ambient conditions, the HVAC system may be operated to maintain a pressure of a working fluid circulated through a working fluid circuit within a desired pressure range. Additionally, by blocking variable speed control of the fan in warmer ambient conditions, overheating of a motor (e.g., single-phase motor) configured to drive operation of the fan may be avoided. In this way, the disclosed techniques enable more reliable operation of the HVAC system. It should be noted that, while the present embodiments are described with reference to (e.g., based on) a detected ambient temperature, the present techniques may be incorporated with reference to additional or alternative operating parameters of the HVAC system that may be indicative of cold ambient conditions. For example, in accordance with present techniques, the control system may additionally or alternatively reference one or more pressures within the HVAC system, one or more temperatures within the HVAC system, and so forth to implement selective modulation of the speed of the fan.

Figure 5:
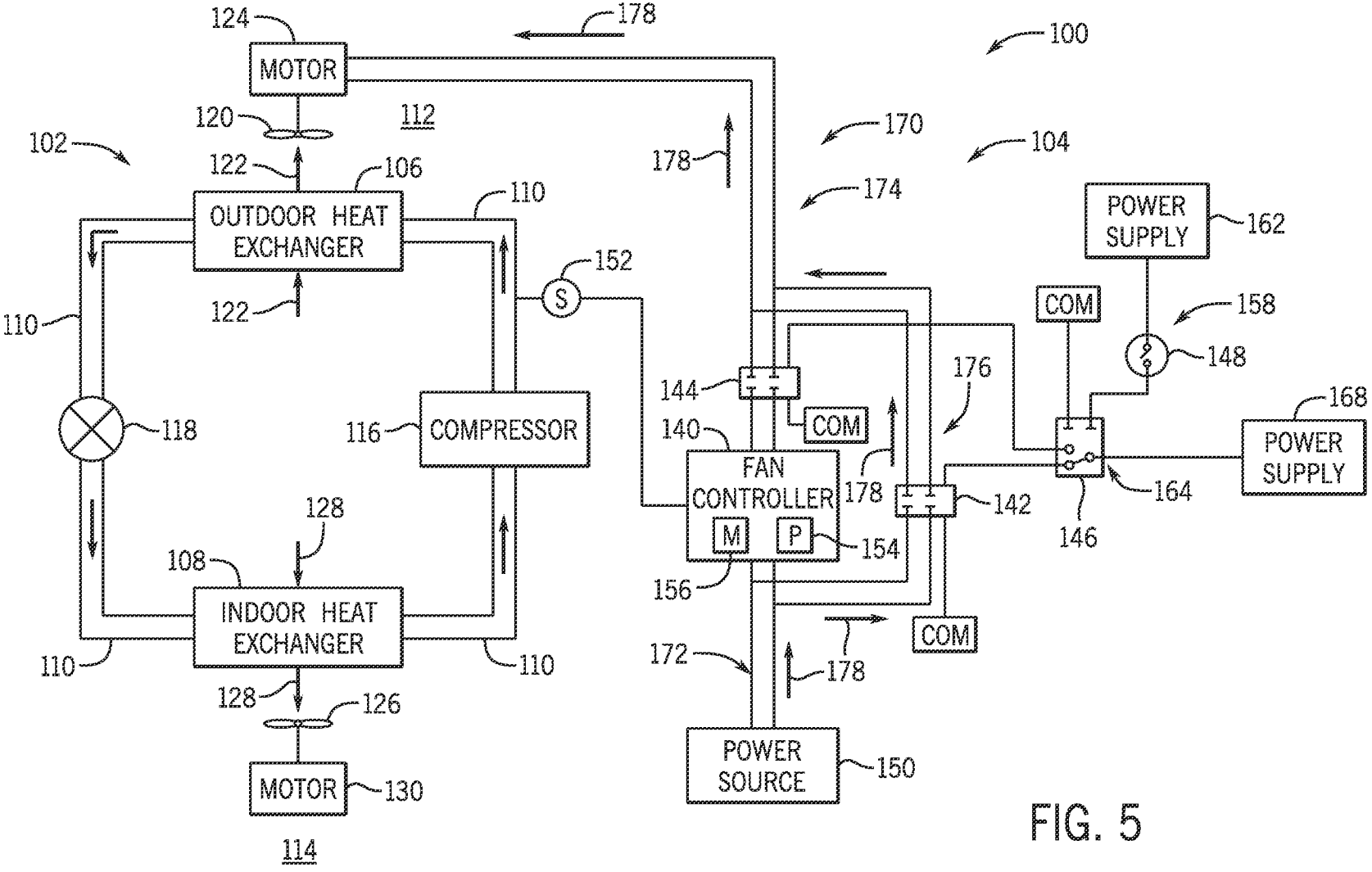
FIG. 5 is a schematic diagram of an embodiment of an HVAC system including a control system for an outdoor fan of the HVAC system, in accordance with an aspect of the present disclosure.

To provide context for the following discussion, FIG. 5 is a schematic of an embodiment of an HVAC system 100 that includes a working fluid circuit 102 and a control system 104 (e.g., fan control system) in accordance with present embodiments. The working fluid circuit 102 may include one or more components of the vapor compression system 72 discussed above and/or may be included in any of the systems described above (e.g., the HVAC unit 12, the heating and cooling system 50). In the illustrated embodiment, the working fluid circuit 102 includes an outdoor heat exchanger 106 (e.g., first heat exchanger) and an indoor heat exchanger 108 (e.g., second heat exchanger) that are fluidly coupled to one another via a one or more conduits 110. The outdoor heat exchanger 106 may be in thermal communication with (e.g., fluidly coupled to) an ambient environment 112 (e.g., the atmosphere) surrounding the HVAC system 100, and the indoor heat exchanger 108 may be in thermal communication with (e.g., fluidly coupled to) a thermal load 114 (e.g., a room, space, and/or device) serviced by the HVAC system 100. As similarly discussed above, the working fluid circuit 102 also includes a compressor 116 configured to circulate a working fluid through the working fluid circuit 102 and an expansion device 118 (e.g., expansion valve, electronic expansion valve) configured to adjust a temperature and/or pressure of the working fluid within the working fluid circuit 102.

The HVAC system 100 further includes an outdoor fan 120 (e.g., condenser fan, first fan) configured to direct (e.g., force, draw) a first air flow 122 (e.g., ambient air flow, outdoor air flow) across the outdoor heat exchanger 106 to facilitate heat exchange between working fluid within the outdoor heat exchanger 106 and the ambient environment 112. Operation (e.g., rotation) of the outdoor fan 120 may be driven by an outdoor fan motor 124 (e.g., fan motor, first fan motor, variable speed motor). In accordance with present techniques, operation of the outdoor fan motor 124 may be controlled and/or regulated by the control system 104, as discussed further below. The outdoor fan motor 124 may be any suitable motor. In some embodiments, the outdoor fan motor 124 may be a single-phase motor, a permanent split capacitor motor, another suitable type of motor, or any combination thereof. The HVAC system 100 may similarly include an indoor fan 126 (e.g., evaporator fan, second fan) configured to direct a second air flow 128 (e.g., supply air flow, return air flow) across the indoor heat exchanger 108 to facilitate heat exchange between working fluid within the indoor heat exchanger 108 and the thermal load 114. To this end, the HVAC system 100 may include an indoor fan motor 130 (e.g., fan motor, second fan motor) configured to drive operation (e.g., rotation) of the indoor fan 126.

It should be appreciated that the HVAC system 100 may include additional components, such as one or more components of the vapor compression system 72 discussed above. In some embodiments, the HVAC system 100 may be configured as a heat pump, and the working fluid circuit 102 may include a reversing valve configured to adjust a flow direction of the working fluid through the working fluid circuit 102. Further, while the disclosed techniques are described below as implemented to control the outdoor fan 120 (e.g., outdoor fan motor 124), it should be appreciated the present techniques may additionally or alternatively be implemented to control the indoor fan 126 (e.g., indoor fan motor 130).

As mentioned above, the HVAC system 100 includes the control system 104 configured to control operation of the outdoor fan motor 124 and thereby control operation of the outdoor fan 120. In some embodiments, one or more components of the control system 104 may be incorporated with another control system (e.g., controller) of the HVAC system 100, such as the control panel 82. In other embodiments, the control system 104 may be a dedicated control system configured to regulate operation of the outdoor fan motor 124. In the illustrated embodiment, the control system 104 includes a fan controller 140 (e.g., fan speed controller), a first contactor 142 (e.g., electrical switch), a second contactor 144 (e.g., electrical switch), a relay 146 (e.g., relay switch), and a temperature switch 148 (e.g., operating parameter switch, single pole single throw [SPST] switch). Details of the components of the control system 104 are described further below.

In the illustrated embodiment, the working fluid circuit 102 is shown as operating in a cooling mode. Thus, the indoor fan 126 may direct the second air flow 128 (e.g., indoor air flow, supply air flow) across the indoor heat exchanger 108 to enable transfer of heat from the second air flow 128 to the working fluid within the indoor heat exchanger 108, thereby cooling the second air flow 128 for supply to a conditioned space. Additionally, in the cooling mode, the outdoor fan 120 may direct the first air flow 122 (e.g., ambient air flow, outdoor air flow) across the outdoor heat exchanger 106 to enable transfer of heat from the working fluid within the outdoor heat exchanger 106 to the first air flow 122. During cold ambient conditions (e.g., low temperatures of the first air flow 122), the first air flow 122 may absorb increased amounts of heat from the working fluid within the outdoor heat exchanger 106, which may cause a pressure and/or a temperature of the working fluid to fall below a desirable level. Accordingly, in the manner described below, the control system 104 may be configured to enable modulation of a speed of the outdoor fan 120 in response to a detected ambient temperature (e.g., temperature of the first air flow 122) falling to or below a threshold value (e.g., lower threshold value). That is, the control system 104 may be configured to enable a reduction in the speed of the outdoor fan 120 (e.g., via the fan controller 140) in response to the detected ambient temperature falling to or below the threshold value.

In some embodiments and/or operating conditions, reducing a speed of the outdoor fan 120 may cause overheating of the outdoor fan motor 124. For example, embodiments of the outdoor fan motor 124 configured as a single-phase motor may be susceptible to overheating during operation of the outdoor fan motor 124 at reduced speeds (e.g., less than full speed). In some embodiments, cooling of the outdoor fan motor 124 may be provided by the first air flow 122. By blocking or avoiding modulation of the speed of the outdoor fan motor 124 (e.g., outdoor fan 120) at higher ambient temperatures, overheating of the outdoor fan motor 124 (e.g., with reduced cooling via the warmer first air flow 122) may be avoided. Accordingly, the control system 104 is also configured to block a reduction in the speed of the outdoor fan 120 (e.g., block operation of the fan controller 140) in response to the detected ambient temperature rising to or above a threshold value (e.g., upper threshold value). It should be appreciated that, in accordance with present techniques, the control system 104 may be configured to enable and/or block modulating of the speed of the outdoor fan 120 and the outdoor fan motor 124 based on detections of ambient temperature values above or below a single threshold value or detections of ambient temperature values above or below multiple threshold values.

To enable the functionality described above, the control system 104 includes the fan controller 140, the first contactor 142, the second contactor 144, the relay 146, and the temperature switch 148. In general, the fan controller 140 is configured to modulate a speed (e.g., operating speed) of the outdoor fan motor 124 and thereby adjust a speed (e.g., rotational speed) of the outdoor fan 120. The fan controller 140 is configured to receive power (e.g., current, voltage) from a power source 150. For example, the power source 150 may be a utility power source, a power source or connection of the HVAC system 100, and/or any other suitable source of electrical power. During operation of the fan controller 140, the fan controller 140 may control or adjust a voltage (e.g., voltage signal) supplied to the outdoor fan motor 124 to cause modulation of a speed of the outdoor fan motor 124 and the outdoor fan 120. In other words, the fan controller 140 may be configured to supply a variable voltage to the outdoor fan motor 124. In some embodiments, the fan controller 140 may adjust the voltage provided to the outdoor fan motor 124 based on feedback provided by a sensor 152 (e.g., one or more sensors, pressure transducer, pressure sensor) of the HVAC system 100 that is communicatively coupled to the fan controller 140. For example, the sensor 152 may be configured to detect a pressure (e.g., discharge pressure) of the working fluid within the working fluid circuit 102 (e.g., downstream of the compressor 116 and upstream of the outdoor heat exchanger 106). The fan controller 140 may adjust the voltage (e.g., output signal) supplied to the outdoor fan motor 124 based on data indicative of the pressure received from the sensor 152 to maintain the pressure of the working fluid at or above a threshold pressure value (e.g., upper threshold pressure value, upper pressure value of compressor 116 operating envelope).

The fan controller 140 may include any suitable components to enable modulation of the speed of the outdoor fan motor 124. For example, the fan controller 140 may include processing circuitry 154, such as one or more microprocessors, which may execute software for controlling the outdoor fan motor 124. The processing circuitry 154 may include multiple microprocessors, one or more "general-purpose" microprocessors, one or more special-purpose microprocessors, and/or one or more application specific integrated circuits (ASICS), or some combination thereof. For example, the processing circuitry 154 may include one or more reduced instruction set (RISC) processors. The fan controller 140 may also include a memory device 156 (e.g., a memory) that may store information such as instructions, control software, look up tables, configuration data, etc. The memory device 156 may include a volatile memory, such as random access memory (RAM), and/or a nonvolatile memory, such as read-only memory (ROM). The memory device 156 may store a variety of information and may be used for various purposes. For example, the memory device 156 may store processor-executable instructions including firmware or software for the processing circuitry 154 execute, such as instructions for controlling the outdoor fan motor 124. In some embodiments, the memory device 156 is a tangible, non-transitory, machine-readable-medium that may store machine-readable instructions for the processing circuitry 154 to execute. The memory device 156 may include ROM, flash memory, a hard drive, or any other suitable optical, magnetic, or solid-state storage medium, or a combination thereof. The memory device 156 may store data, instructions, and any other suitable data. In some embodiments, the fan controller 140 may additionally or alternatively include a variable speed drive (VSD), a variable frequency drive (VFD), or other speed control component configured to enable modulation of a speed of the outdoor fan motor 124.

Figure 6:
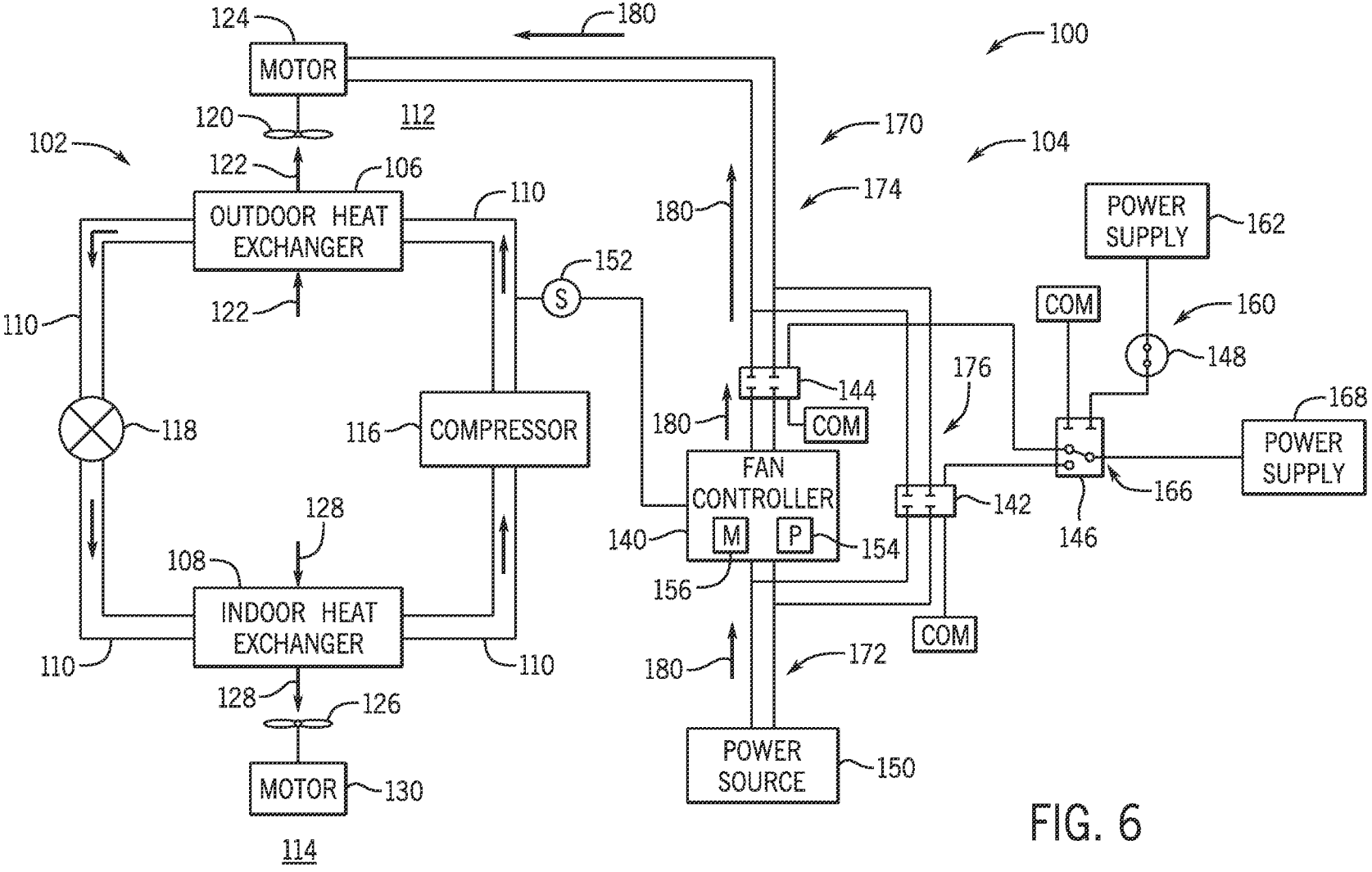
FIG. 6 is a schematic diagram of an embodiment of an HVAC system including a control system for an outdoor fan of the HVAC system, in accordance with an aspect of the present disclosure.

During certain operating conditions, it may be desirable to block operation of the fan controller 140 to thereby block modulation (e.g., reduction) of a speed of the outdoor fan motor 124 to avoid overheating of the outdoor fan motor 124. In particular, during warmer ambient conditions (e.g., temperatures of the first air flow 122 at or above a threshold value), the control system 104 may be configured to block operation of the fan controller 140 and enable full speed operation of the outdoor fan motor 124. To this end, the control system 104 includes the temperature switch 148. The temperature switch 148 may be a temperature limit control switch, an automatic reset switch, an open faced switch, a bimetallic switch, a disc switch, another suitable temperature switch, or any combination thereof. In some embodiments, the temperature switch 148 may be a normally closed switch, and in other embodiments the temperature switch 148 may be a normally open switch. Accordingly, the temperature switch 148 is configured to transition between an open configuration 158, as shown in FIG. 5, and a closed configuration 160, as shown in FIG. 6, based on a temperature (e.g., ambient temperature, temperature of the first air flow 122) detected by the temperature switch 148. However, as mentioned above, it should be appreciated that other embodiments of the control system 104 may include a switch configured to perform the functions described herein based on detection of another operating parameter of the HVAC system 100 (e.g., working fluid temperature, working fluid pressure, etc.).

Further, in some embodiments, the temperature switch 148 may be configured to transition between the open configuration 158 and the closed configuration 160 based on detections of different ambient temperatures. That is, the temperature switch 148 may be configured to transition to the open configuration 158 in response to detection of an ambient temperature at or above a first threshold value (e.g., upper threshold value, open value), and the temperature switch 148 may be configured to transition to the closed configuration 160 in response to detection of an ambient temperature at or below a second threshold value (e.g., lower threshold value, reset value), where the second threshold value is less than the first threshold value. As an example, the first threshold value may be 55 degrees Fahrenheit (° F.), and the second threshold value may be 45° F. However, any suitable values for the first and second threshold values may be selected for a particular embodiment of the temperature switch 148.

The temperature switch 148 is electrically coupled to a power supply 162 and is electrically coupled to the relay 146. The power supply 162 may be configured to supply a signal (e.g., electrical signal, current), such as 24 volts alternating current (VAC), to the temperature switch 148. In some embodiments, the power supply 162 may be a transformer of the HVAC system 100. As mentioned above, the temperature switch 148 is in the open configuration 158 in the illustrated embodiment. Thus, an ambient temperature detected by the temperature switch 148 is greater than or equal to a threshold value (e.g., first threshold value, upper threshold value, open value). In the open configuration 158, the temperature switch 148 blocks transmission of the signal (e.g., 24 VAC, current) from the power supply 162 to the relay 146. As a result, the relay 146 may not be energized by the signal received from the temperature switch 148. Based on nonreceipt of the signal from the temperature switch 148, the relay 146 may be in a first configuration 164, as shown in the illustrated embodiment. For example, the relay 146 may be a single pole double throw (SPDT) relay configured to transition between the first configuration 164 and a second configuration 166, as shown in FIG. 6 and described further below, based on receipt and nonreceipt of the signal from the temperature switch 148.

The relay 146 is electrically coupled to a power supply 168, which may be the same as or different from the power supply 162 electrically coupled to the temperature switch 148. For example, the power supply 168 may be a transformer of the HVAC system 100 and may be configured to supply a signal (e.g., electrical signal, current), such as 24 VAC, to the relay 146. Based on the configuration (e.g., first configuration 164, second configuration 166) of the relay 146, the relay 146 is configured to output and transmit the signal from the power supply 168 to the first contactor 142 or the second contactor 144. To this end, the relay 146 is electrically coupled to both the first contactor 142 and the second contactor 144.

In the illustrated embodiment, the relay 146 is in the first configuration 164, whereby the relay 146 is configured to transmit the signal (e.g., current) received from the power supply 168 to the first contactor 142. In other words, in the first configuration 164. the relay 146 electrically couples the power supply 168 and the first contactor 142. At the same time, the relay 146 electrically decouples the power supply 168 and the second contactor 144 in the first configuration 164. Thus, the second contactor 144 does not receive the signal from the power supply 168 via the relay 146 in the first configuration 164. In response to receipt of the signal from the relay 146, the first contactor 142 (e.g., a coil of the first contactor 142) may be energized, and contacts of the first contactor 142 may be closed. By contrast, in response to nonreceipt of the signal from the relay 146, the second contactor 144 (e.g., a coil of the second contactor 144) may not be energized, and contacts of the second contactor 144 may be opened.

As shown, the first contactor 142 is generally arranged in parallel with the fan controller 140 and the second contactor 144 along a transmission line 170 (e.g., power transmission line, signal transmission line, wiring) extending from the power source 150 to the outdoor fan motor 124. The second contactor 144 and the fan controller 140 are arranged in series with one another along the transmission line 170. Specifically, the transmission line 170 includes an input line 172 (e.g., input signal transmission line, wiring) extending from the power source 150 to the fan controller 140 and an output line 174 (e.g., output signal transmission line, wiring) extending from the fan controller 140 to the outdoor fan motor 124. The second contactor 144 is disposed along the output line 174 between the fan controller 140 and the outdoor fan motor 124. The transmission line 170 also includes a bypass line 176 (e.g., bypass signal transmission line, bypass power transmission line, wiring) extending from the input line 172 (e.g., upstream of the fan controller 140 relative to flow of current through the transmission line 170) to the output line 174 (e.g., downstream of the second contactor 144 relative to flow of current through the transmission line 170). The first contactor 142 is disposed along the bypass line 176. Thus, the second contactor 144 and the fan controller 140 are arranged in series with one another along the transmission line 170, and the first contactor 142 is arranged in parallel with the second contactor 144 and the fan controller 140 along the transmission line 170.

As mentioned above, in the first configuration 164 of the relay 146, the relay 146 is configured to transmit the signal from the power supply 168 to the first contactor 142 and block transmission of the signal from the power supply 168 to the second contactor 144. Therefore, in the illustrated embodiment, the first contactor 142 is closed (e.g., activated, actuated, engaged), and the second contactor 144 is opened (e.g., deactivated, disengaged). With the first contactor 142 closed and the second contactor 144 opened, a signal transmission path (e.g., power transmission path) of the transmission line 170 is created from the power source 150, along the input line 172 to the bypass line 176, along the bypass line 176 and through the first contactor 142 to the output line 174, as indicated by arrows 178. Thus, power may flow from the power source 150 directly to the outdoor fan motor 124 via the first contactor 142 in the closed configuration. In other words, power from the power source 150 may bypass the fan controller 140, such that the fan controller 140 is blocked from providing a variable voltage to the outdoor fan motor 124. Indeed, the second contactor 144 in the open configuration may block transmission of power (e.g., variable voltage) from the fan controller 140 to the outdoor fan motor 124. Accordingly, modulation of a speed of the outdoor fan motor 124 and the outdoor fan 120 may be blocked. Instead, power (e.g., full power) may be supplied directly from the power source 150 to the outdoor fan motor 124 via the first contactor 142 in the closed configuration to cause operation of the outdoor fan motor 124 at full speed. In this way, the control system 104 may cause operation of the outdoor fan motor 124 at full speed in response to detection of an ambient temperature (e.g., via the temperature switch 148) above a threshold value (e.g., upper threshold value, open value), and overheating of the outdoor fan motor 124 that may otherwise result from modulated operation (e.g., reduced speed) of the outdoor fan motor 124 may be avoided.

FIG. 6 is a schematic of an embodiment of the HVAC system 100 including the working fluid circuit 102 and the control system 104 (e.g., fan control system) in accordance with present embodiments. The illustrated embodiment includes similar elements and element numbers as those described above. Additionally, the temperature switch 148 is illustrated in the closed configuration 160. Thus, an ambient temperature detected by the temperature switch 148 is less than or equal a threshold value (e.g., second threshold value, lower threshold value, reset value), which causes the temperature switch to transition from the open configuration 158 to the closed configuration 160. In other words, the temperature switch 148 may be in the closed configuration 160 in response to detection of a cold ambient condition. In the closed configuration 160, the temperature switch 148 electrically couples the power supply 162 to the relay 146. Thus, the temperature switch 148 is configured to transmit the signal (e.g., 24 VAC) from the power supply 162 to the relay 146 in the closed configuration 160. As a result, the relay 146 (e.g., a coil of the relay 146) may be energized by the signal received from the temperature switch 148, which causes the relay 146 to transition to the second configuration 166.

In the second configuration 166, the relay 146 is configured to transmit the signal received from the power supply 168 to the second contactor 144. In other words, in the second configuration 166. the relay 146 electrically couples the power supply 168 and the second contactor 144. At the same time, the relay 146 electrically decouples the power supply 168 and the first contactor 142 in the second configuration 166. Thus, the first contactor 142 does not receive the signal from the power supply 168 via the relay 146 in the second configuration 166. In response to receipt of the signal from the relay 146, the second contactor 144 (e.g., a coil of the second contactor 144) may be energized, and contacts of the second contactor 144 may be closed (e.g., activated, actuated, engaged). On the other hand, in response to nonreceipt of the signal from the relay 146, the first contactor 142 (e.g., a coil of the first contactor 142) may not be energized, and contacts of the first contactor 142 may be opened (e.g., deactivated, disengaged).

With the second contactor 144 closed and the first contactor 142 opened, a signal transmission path (e.g., power transmission path) of the transmission line 170 is created from the power source 150, along the input line 172 to the fan controller 140, and from the fan controller 140 to the outdoor fan motor 124 along the output line 174 via the second contactor 144, as indicated by arrows 180. Thus, power may flow from the power source 150 to the fan controller 140, and the fan controller 140 may output power (e.g., a variable voltage) to the outdoor fan motor 124 via the second contactor 144 in the closed configuration. Therefore, the fan controller 140 may operate to modulate a speed of the outdoor fan motor 124 in the manner described above. The fan controller 140 may output a particular variable voltage to the outdoor fan motor 124 based on data indicative of a pressure of the working fluid, or other operating parameter of the HVAC system 100, received by the fan controller 140 from the sensor 152. For example, the fan controller 140 may adjust a speed of the outdoor fan motor 124 and the outdoor fan 120 to adjust an amount of the first air flow 122 directed across the outdoor heat exchanger 106 to maintain a pressure of the working fluid within the working fluid circuit above a threshold value. In some embodiments, the fan controller 140 may adjust a speed of the outdoor fan motor 124 and the outdoor fan 120 to achieve a greater pressure (e.g., discharge pressure) of the working fluid that avoids operational inefficiencies of other components of the HVAC system 100, such as the expansion device 118, while also avoiding overheating of the outdoor fan motor 124. Further, with the first contactor 142 in the open configuration, transmission of power to the outdoor fan motor 124 via the bypass line 176 is blocked.

As discussed above, the temperature switch 148 may be configured to transition from between the open configuration 158 and the closed configuration 160 in response to detection of an ambient temperature or other suitable temperature above and/or below one or more threshold values. For example, the temperature switch 148 may be configured to transition to the open configuration 158 in response to detection of an ambient temperature value above a first threshold value (e.g., 55° F.), and the temperature switch 148 may be configured to transition to the closed configuration 160 in response to detection of an ambient temperature value below a second threshold value (e.g., 45° F.) that is less than the first threshold value. Accordingly, in some operating conditions, the temperature switch 148 may be in either the open configuration 158 or the closed configuration 160 during instances in which the ambient temperature is between the first threshold value and the second threshold value. A particular configuration of the temperature switch 148 in such instances may be based on an existing and/or previous (e.g., immediately prior) configuration of the temperature switch 148.

With the foregoing in mind, it may be desirable to enable further improved control of the outdoor fan motor 124 and the outdoor fan 120 during periods in which the ambient temperature is within a particular temperature band or range (e.g., between a first or upper threshold value and a second or lower threshold value). Accordingly, some embodiments of the control system 104 may include multiple temperature switches 148 (e.g., operating parameter switches).

Figure 7:
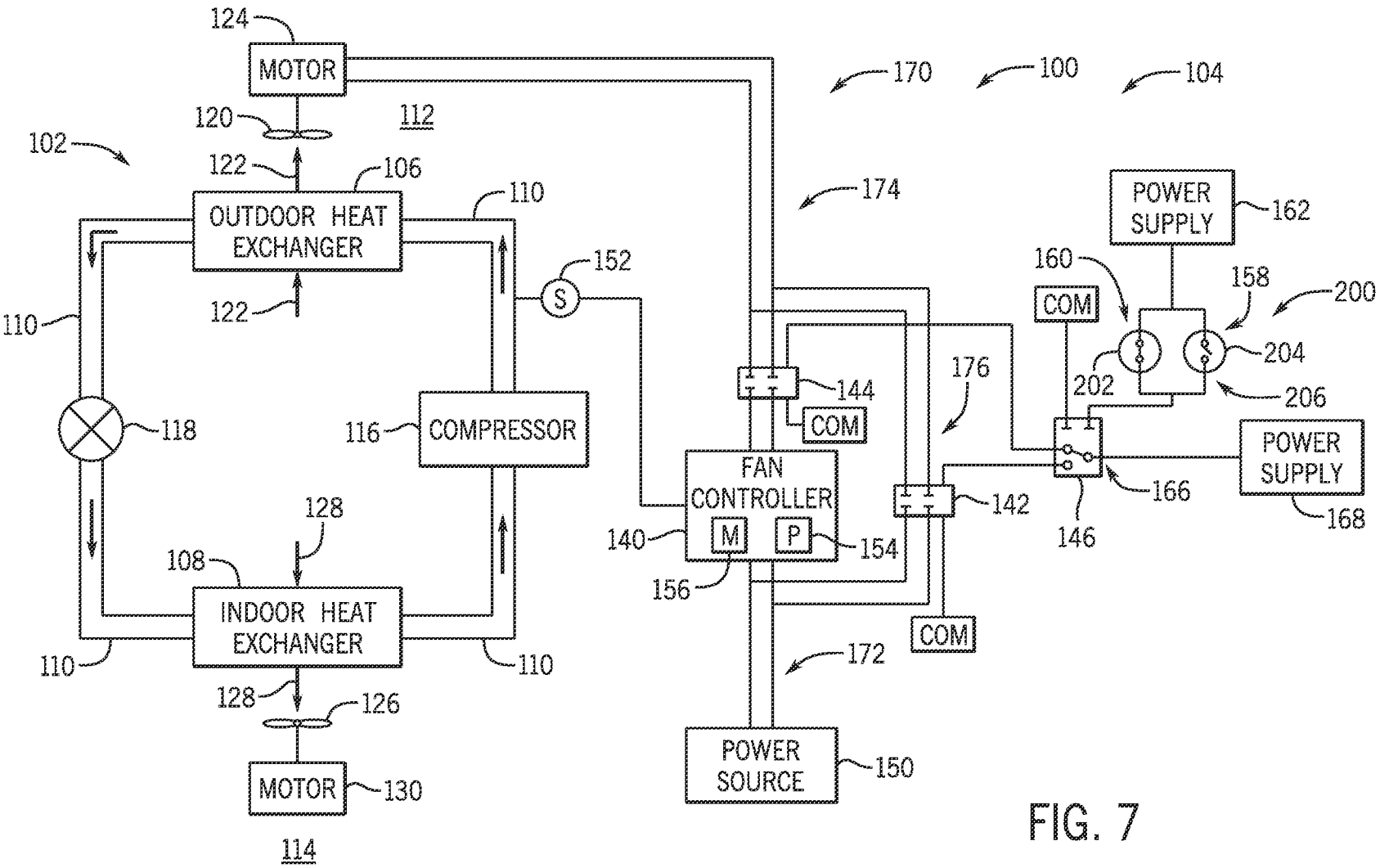
FIG. 7 is a schematic diagram of an embodiment of an HVAC system including a control system for an outdoor fan of the HVAC system, in accordance with an aspect of the present disclosure.
Figure 8:
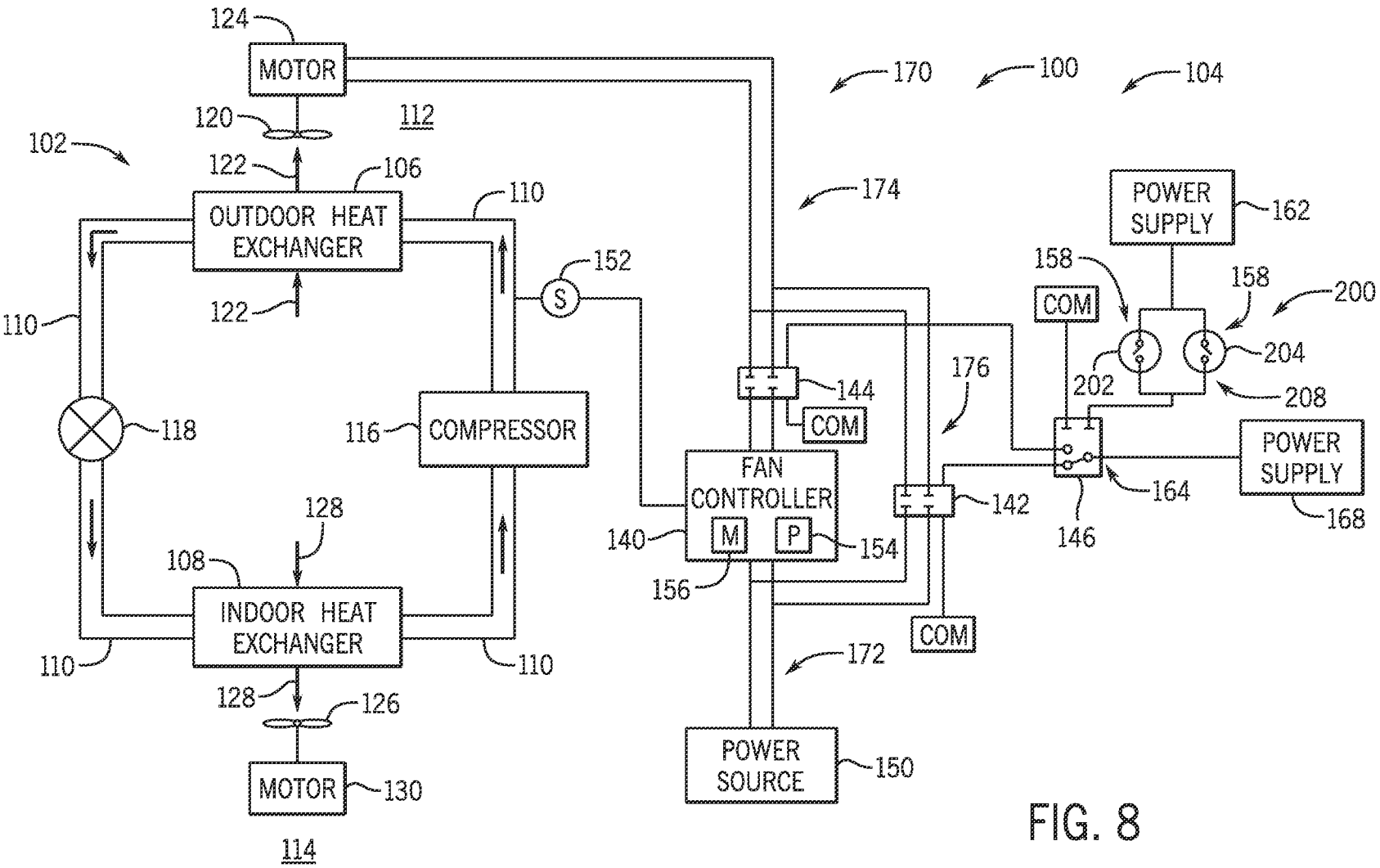
FIG. 8 is a schematic diagram of an embodiment of an HVAC system including a control system for an outdoor fan of the HVAC system, in accordance with an aspect of the present disclosure.
Figure 9:
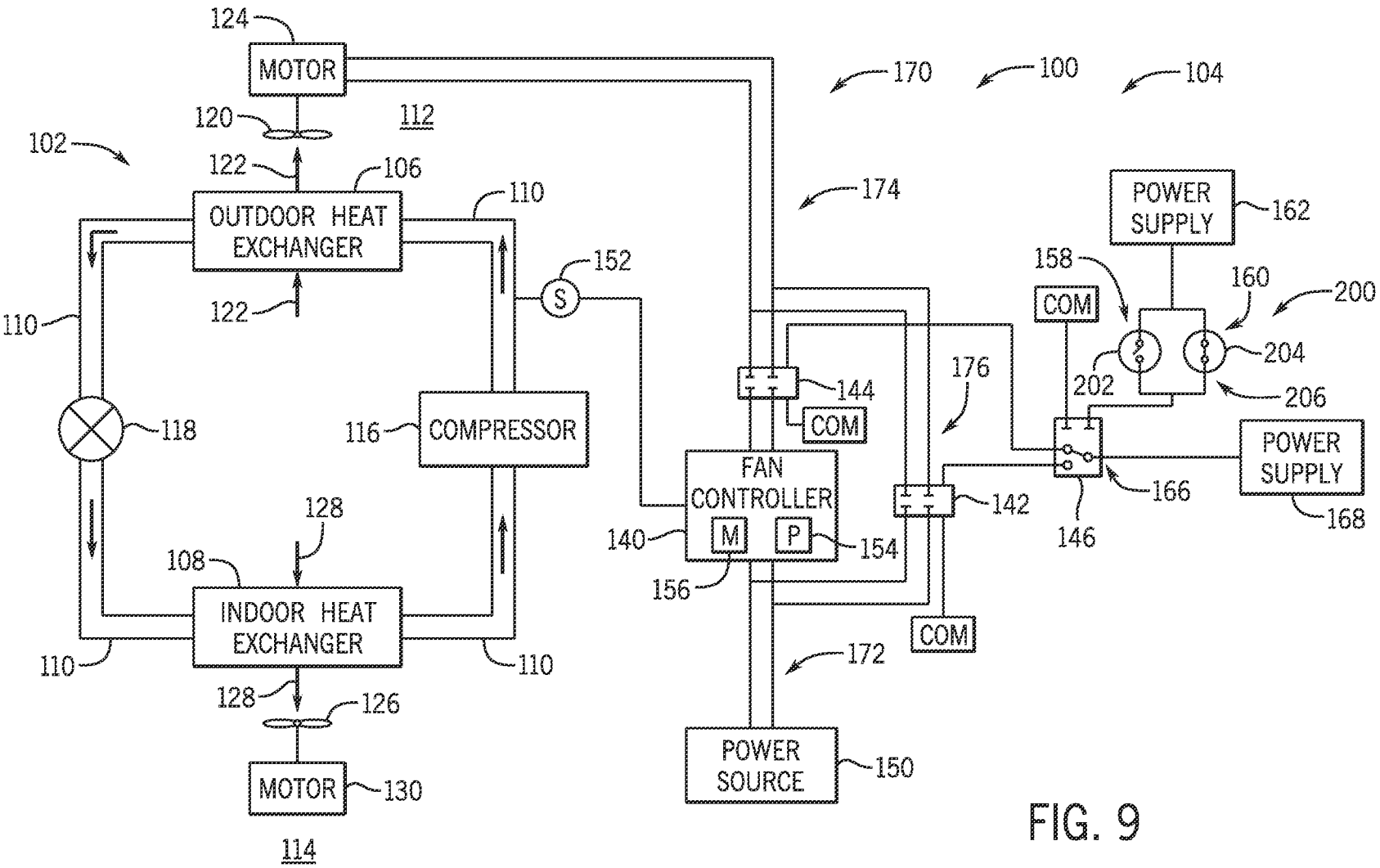
FIG. 9 is a schematic diagram of an embodiment of an HVAC system including a control system for an outdoor fan of the HVAC system, in accordance with an aspect of the present disclosure.

FIGS. 7-9 are schematics of an embodiment of the HVAC system 100 including the working fluid circuit 102 and the control system 104 (e.g., fan control system) including a switch system 200 (e.g., temperature switch system, temperature switch arrangement, switch circuit, multi-switch circuit) having two temperature switches 148. That is, the switch system 200 includes a first temperature switch 202 and a second temperature switch 204. The illustrated embodiments also include similar elements and element numbers as those discussed above with reference to FIGS. 5 and 6. The first temperature switch 202 and the second temperature switch 204 may each be an embodiment of the temperature switch 148 discussed above. However, in other embodiments, the first temperature switch 202 and the second temperature switch 204 may each be any suitable switch configured to actuate in response to an ambient temperature value detected by the respective switch.

In the illustrated embodiment, the first temperature switch 202 and the second temperature switch 204 are arranged in parallel with one another. Specifically, as similarly discussed above, the first temperature switch 202 and the second temperature switch 204 are each electrically coupled to the power supply 162 and are each electrically coupled to the relay 146. In accordance with present techniques, each of the first temperature switch 202 and the second temperature switch 204 may be configured to transition between respective open and closed configurations 158, 160 in response to detections of one or more respective ambient temperature values (e.g., one or more threshold values) associated with each temperature switch 148.

For example, FIG. 7 illustrates the first temperature switch 202 in the closed configuration 160 and the second temperature switch 204 in the open configuration 158. Thus, the switch system 200 may be in a closed configuration 206 whereby the power supply 168 is electrically coupled to the relay 146 (e.g., via the first temperature switch 202). As a result, a signal received by the switch system 200 from the power supply 162 may be transmitted to the relay 146 to energize the relay. In some embodiments, the first temperature switch 202 may be a normally closed switch configured to transition to the open configuration 158 in response to detection of an ambient temperature value greater than a first threshold value (e.g., first open value), such as 45° F. or any other suitable value. The first threshold value associated with the first temperature switch 202 may be a lower limit value of a particular temperature band or range within which improved control of the outdoor fan motor 124 is desired.

In some embodiments, the first temperature switch 202 may be configured to transition from the open configuration 158 to the closed configuration 160 in response to detection of an ambient temperature value below the first threshold value or, alternatively, in response to detection of an ambient temperature value below a first reset value (e.g., first additional threshold value) that is below the first threshold value. However, it should be appreciated that the first temperature switch 202 may have other configurations, such as a normally open configuration, and/or may be configured to actuate or transition between the closed configuration 160 and the open configuration 158 in response to detection of one or more different threshold values.

The second temperature switch 204 may be a normally open switch configured to transition from the open configuration 158 to the closed configuration 160 in response to detection of an ambient temperature value greater than a second threshold value (e.g., second closed value), such as 55° F. The second threshold value associated with the second temperature switch 204 may be an upper limit value of a particular temperature band or range within which improved control of the outdoor fan motor 124 is desired. Thus, the second threshold value configured to actuate transition of the second temperature switch 204 from the open configuration 158 to the closed configuration 160 may be greater than the first threshold value associated with the first temperature switch 202. In some embodiments, the second temperature switch 204 may be configured to transition from the closed configuration 160 to the open configuration 158 in response to detection of an ambient temperature value below the second threshold value or, alternatively, in response to detection of an ambient temperature value below a second reset value (e.g., second additional threshold value) that is below the second threshold value. However, it should be appreciated that the second temperature switch 204 may also have other configurations, such as a normally closed configuration, and/or may be configured to actuate or transition between the closed configuration 160 and the open configuration 158 in response to detection of one or more different threshold values.

In the illustrated closed configuration 206 of the switch system 200, the switch system 200 is configured to transmit a signal from the power supply 162 to the relay 146, as discussed above. As a result, the relay 146 may be energized and may transition to the second configuration 166, whereby the relay 146 transmits a signal from the power supply 168 to the second contactor 144. In this way, the second contactor 144 may be closed, and the first contactor 142 may be open to enable control of the outdoor fan motor 124 via the fan controller 140. That is, with the switch system 200 in the closed configuration 206 (e.g., at ambient temperatures at or below the first threshold value), the control system 104 may enable the fan controller 140 to modulate (e.g., reduce) a speed of the outdoor fan motor 124 and the outdoor fan 120, such as based on a discharge pressure of the working fluid detected by the sensor 152.

In response to detection of an ambient temperature value greater than the first threshold value and less than the second threshold value (e.g., within the particular temperature band or range), the first temperature switch 202 may transition to the open configuration 158. The second temperature switch 204 may remain in the open (e.g., normally open) configuration 158. Thus, the switch system 200 may transition to an open configuration 208, as shown in FIG. 8. With the first temperature switch 202 and the second temperature switch 204 in respective open configurations 158, transmission of the signal from the power supply 162 to the relay 146 may be interrupted and/or blocked. Thus, the relay 146 may not be energized. In response, the relay 146 may transition from the second configuration 166 to the first configuration 164, whereby the relay 146 transmits a signal from the power supply 168 to the first contactor 142. In this way, the first contactor 142 may be closed, and the second contactor 144 may be open to enable control bypass of power from the power source 150 to (e.g., directly to) the outdoor fan motor 124 via the first contactor 142. In other words, operation of the fan controller 140 to modulate a speed of the outdoor fan motor 124 may be interrupted. As will be appreciated, the first and second threshold values of the first and second temperature switches 202, 204 may be selected to enable operation of the outdoor fan motor 124 at full speed within a particular ambient temperature range within which the outdoor fan motor 124 may be particular susceptible to overheating. By blocking modulation of the speed of the outdoor fan motor 124 via the fan controller 140 within the particular ambient temperature range, overheating of the outdoor fan motor 124 may be reduced, and more reliable operation of the HVAC system 100 may be achieved.

In response to detection of an ambient temperature value greater than the second threshold value (e.g., greater than the particular temperature band or range), the second temperature switch 204 may transition to the closed configuration 160. The first temperature switch 202 may remain in the open configuration 158. Thus, the switch system 200 may therefore transition to the closed configuration 206, as shown in FIG. 9. In the illustrated closed configuration 206 of the switch system 200, the switch system 200 is configured to transmit a signal from the power supply 162 to the relay 146 (e.g., via the second temperature switch 204), as similarly discussed above. As a result, the relay 146 may be energized and may transition to the second configuration 166, whereby the relay 146 transmits a signal from the power supply 168 to the second contactor 144. In this way, the second contactor 144 may be closed, and the first contactor 142 may be open to enable control of the outdoor fan motor 124 via the fan controller 140. That is, with the switch system 200 in the closed configuration 206 (e.g., at ambient temperatures at or greater than the second threshold value), the control system 104 may enable the fan controller 140 to modulate (e.g., reduce) a speed of the outdoor fan motor 124 and the outdoor fan 120, such as based on a discharge pressure of the working fluid detected by the sensor 152.

In should be appreciated that other embodiments of the control system 104 incorporating the presently disclosed techniques may include additional or alternative elements configured to enable the operations described above. For example, one or more of the temperature switches 148, 202, 204 may be configured to transition between respective open and closed configurations 158, 160 based on detection of ambient temperature values above or below a single threshold value. In some embodiments, the temperature switch 148 may be a single pole double throw (SPDT) switch. As will be appreciated, in such embodiments, the control system 104 may not include the relay 146. Instead, the temperature switch 148 may be configured to selectively direct a signal to the first contactor 142 and the second contactor 144. Further, in some embodiments, the control system 104 may include a single pole double throw (SPDT) contactor (e.g., a single contactor) instead of the first contactor 142 and the second contactor 144. It will be appreciated that such variations may nevertheless incorporate the present techniques and enable improved control of the outdoor fan motor 124 and the outdoor fan 120 to achieve desired pressures (e.g., discharge pressures) of a working fluid within the working fluid circuit 102 while also avoiding overheating of the outdoor fan motor 124 in particular operating conditions (e.g., ambient temperatures).

As set forth above, embodiments of the present disclosure may provide one or more technical effects useful for enabling improved operation of a fan, such as an outdoor fan and/or a condenser fan, based on a detected ambient temperature. Specifically, the HVAC system includes a control system configured to selectively enable modulation of a speed of the fan and selectively bypass (e.g., block) modulation of the speed of the fan based on the detected ambient temperature. For example, the control system may be configured to enable modulation of the fan speed at lower ambient temperatures and may be configured to block modulation of the fan speed at higher ambient temperatures. To this end, the control system may include a fan controller (e.g., speed controller), one or more temperature switches, one or more relays, and one or more contactors. By enabling variable speed control of the fan during colder ambient conditions, the HVAC system may be operated to maintain a pressure of a working fluid within a desired pressure range, and by blocking variable speed control of the fan in warmer ambient conditions, overheating of the fan motor (e.g., single-phase motor) may be avoided. In this way, the disclosed techniques enable more reliable operation of the HVAC system. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and air conditioning (HVAC) system, comprising:

an outdoor heat exchanger configured to circulate a working fluid therethrough and to place the working fluid in a heat exchange relationship with an ambient air flow;

a fan configured to direct the ambient air flow across the outdoor heat exchanger;

a single-phase motor configured to drive rotation of the fan; and a control system electrically coupled to the single-phase motor, wherein the control system comprises a fan controller configured to modulate a speed of the fan, a first contactor, and a second contactor, and the control system is configured to:

close the first contactor to enable supply of power to the single-phase motor and open the second contactor to disable electrical communication from the fan controller to the single-phase motor in response to detection of a value of an ambient temperature above a threshold value; and open the first contactor and close the second contactor to enable electrical communication from the fan controller to the single-phase motor in response to detection of the value of the ambient temperature below the threshold value.

2. The HVAC system of claim 1, wherein the fan controller is configured to receive power from a power source, the first contactor is disposed between the power source and the single-phase motor in parallel with the fan controller, the first contactor is configured to electrically couple the power source and the single-phase motor, such that the first contactor is configured to direct power from the power source to the single-phase motor and bypass the fan controller, the second contactor is disposed between the fan controller and the single-phase motor, and the second contactor is configured to electrically couple the fan controller and the single-phase motor.

3. The HVAC system of claim 2, wherein the control system comprises a relay electrically coupled to the first contactor and to the second contactor, wherein the relay is configured to output a signal to selectively close the first contactor and open the second contactor and to selectively open the first contactor and close the second contactor.

4. The HVAC system of claim 3, wherein the relay is a single pole double throw (SPDT) relay.

5. The HVAC system of claim 3, wherein the signal is a first signal, the control system comprises a temperature switch electrically coupled to the relay, the temperature switch is configured to detect the ambient temperature, and the temperature switch is configured to selectively direct a second signal to the relay based on the value of the ambient temperature.

6. The HVAC system of claim 5, wherein the temperature switch is configured to be in an open configuration and interrupt supply of the second signal to the relay in response to the value of the ambient temperature being above the threshold value, the relay is configured to transition to a first configuration in response to interruption in supply of the second signal to the relay from the temperature switch, and the relay is configured to direct the first signal to the first contactor to close the first contactor in the first configuration.

7. The HVAC system of claim 6, wherein the threshold value is a first threshold value, the temperature switch is configured to transition to a closed configuration and supply the second signal to the relay in response to the value of the ambient temperature being below a second threshold value, the relay is configured to transition to a second configuration in response to receipt of the second signal from the temperature switch, and the relay is configured to direct the first signal to the second contactor to close the second contactor in the second configuration.

8. The HVAC system of claim 7, wherein the second threshold value is less than the first threshold value.

9. The HVAC system of claim 7, wherein the control system comprises a pressure sensor configured to detect a pressure of the working fluid discharged by a compressor of the HVAC system, the pressure sensor is communicatively coupled to the fan controller, and the fan controller is configured to modulate the speed of the fan based on the pressure of the working fluid.

10. The HVAC system of claim 6, wherein the relay is configured to receive the first signal from a transformer of the HVAC system, the temperature switch is configured to receive the second signal from the transformer of the HVAC system, or both.

11. A fan control system for a heating, ventilation, and air conditioning (HVAC) system, comprising:

a fan controller configured to modulate a speed of a fan configured to direct an ambient air flow across an outdoor heat exchanger, wherein the fan controller is configured to receive power from a power source and to output a variable voltage to a single-phase motor of the fan;

a first contactor disposed along a bypass line extending between the power source and the single-phase motor in parallel with the fan controller, wherein the first contactor is configured to electrically couple the power source and the single-phase motor, such that the first contactor is configured to direct power from the power source to the single-phase motor and bypass the fan controller; and a second contactor disposed along an output line extending from the fan controller to the single-phase motor, wherein the second contactor is configured to electrically couple the fan controller and the single-phase motor, wherein the fan control system is configured to selectively close the first contactor and open the second contactor and to selectively open the first contactor and close the second contactor based on an ambient temperature detected by the fan control system, and the bypass line is electrically coupled to the output line between the second contactor and the single-phase motor.

12. The HVAC system of claim 11, comprising a relay electrically coupled to the first contactor and to the second contactor, wherein the relay is configured to transition between a first configuration and a second configuration based on the ambient temperature detected by the fan control system, the relay is configured to output a signal to the first contactor in the first configuration, and the relay is configured to output the signal to the second contactor in the second configuration.

13. The HVAC system of claim 12, wherein the signal is a first signal, the fan control system comprises a temperature switch configured to detect the ambient temperature, the temperature switch is configured to output a second signal based on the ambient temperature, and the relay is configured to transition between the first configuration and the second configuration based on receipt of the second signal from the temperature switch.

14. The HVAC system of claim 13, wherein the temperature switch is a bimetallic switch.

15. The HVAC system of claim 13, wherein the temperature switch is configured to transition to an open configuration in response to the ambient temperature being above a first threshold value, the temperature switch is configured to interrupt supply of the second signal in the open configuration, the temperature switch is configured to transition to a closed configuration in response to the ambient temperature being below a second threshold value, and the temperature switch is configured to output the second signal in the closed configuration.

16. The HVAC system of claim 15, wherein the relay is configured to transition to the first configuration in response to nonreceipt of the second signal from the temperature switch, and the relay is configured to transition to the second configuration in response to receipt of the second signal from the temperature switch.

17. A heating, ventilation, and air conditioning (HVAC) system, comprising:

a single-phase motor configured to drive rotation of a fan to direct an ambient air flow across an outdoor heat exchanger; and a control system electrically coupled to the single-phase motor and configured to control operation of the single-phase motor, wherein the control system comprises:

a fan controller configured to receive power from a power source and to output a variable voltage to the single-phase motor to modulate a speed of the fan;

a first contactor configured to be disposed between the power source and the single-phase motor in parallel with the fan controller;

a second contactor configured to be disposed between the fan controller and the single-phase motor and in series with the fan controller and the single-phase motor;

a temperature switch configured to detect an ambient temperature, wherein the temperature switch is configured to selectively output a first signal based on a value of the ambient temperature; and a relay electrically coupled to the temperature switch, the first contactor, and the second contactor, wherein the relay is configured to output a second signal to the first contactor to close the first contactor and open the second contactor in response to nonreceipt of the first signal from the temperature switch, and the relay is configured to output the second signal to the second contactor to close the second contactor and open the first contactor in response to receipt of the first signal from the temperature switch.

18. The HVAC system of claim 17, wherein the first contactor is configured to transition to a closed configuration to electrically couple the power source and the single-phase motor, such that the first contactor is configured to direct power from the power source to the single-phase motor and bypass the fan controller, in response to receipt of the second signal from the relay, and the second contactor is configured to transition to an open configuration to interrupt supply of the variable voltage to the single-phase motor in response to nonreceipt of the second signal from the relay.

19. The HVAC system of claim 17, wherein the first contactor is configured to transition to an open configuration to interrupt supply of power directly from the power source to the single-phase motor in response to nonreceipt of the second signal from the relay, and the second contactor is configured to transition to a closed configuration to enable supply of the variable voltage to the single-phase motor via the fan controller in response to receipt of the second signal from the relay.

* * * * *